US011780695B2

(12) United States Patent
Kurita

(10) Patent No.: US 11,780,695 B2
(45) Date of Patent: Oct. 10, 2023

(54) IMAGE FORMING APPARATUS

(71) Applicant: TOSHIBA TEC KABUSHIKI KAISHA, Tokyo (JP)

(72) Inventor: Eizo Kurita, Sunto Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 210 days.

(21) Appl. No.: 17/470,268

(22) Filed: Sep. 9, 2021

(65) Prior Publication Data

US 2023/0072520 A1 Mar. 9, 2023

(51) Int. Cl.

| | |
|---|---|
| ***B65H 5/06*** | (2006.01) |
| ***B65H 7/20*** | (2006.01) |
| ***B65H 7/02*** | (2006.01) |

(52) U.S. Cl.

CPC ..... *B65H 7/20* (2013.01); *B65H 5/062* (2013.01); *B65H 7/02* (2013.01); *B65H 2403/724* (2013.01); *B65H 2403/92* (2013.01); *B65H 2513/11* (2013.01); *B65H 2553/51* (2013.01); *B65H 2801/06* (2013.01)

(58) Field of Classification Search

CPC ..... B65H 5/062; B65H 5/06; B65H 5/068; B65H 2403/724; B65H 2513/11; B65H 2513/10; B65H 2513/512; B65H 2553/51; B65H 7/20; B65H 7/02; B65H 3/0669

See application file for complete search history.

(56) References Cited

U.S. PATENT DOCUMENTS

| | | | | |
|---|---|---|---|---|
| 2009/0219552 | A1 | 9/2009 | Igarashi | |
| 2016/0152425 | A1* | 6/2016 | Inoue | B65H 5/062 271/10.03 |
| 2018/0176399 | A1* | 6/2018 | Umi | H04N 1/00615 |
| 2019/0023513 | A1* | 1/2019 | Hirano | G03G 15/6511 |

FOREIGN PATENT DOCUMENTS

| | | | |
|---|---|---|---|
| JP | S62194262 | A | 8/1987 |
| JP | H04189240 | A | 7/1992 |
| JP | 2001341900 | A | 12/2001 |
| JP | 2003128273 | A | 5/2003 |
| JP | 2006021855 | A | 1/2006 |
| JP | 2008044683 | A | 2/2008 |
| JP | 2010155345 | A | 7/2010 |

* cited by examiner

*Primary Examiner* — Luis A Gonzalez

(74) *Attorney, Agent, or Firm* — Kim & Stewart LLP

(57) ABSTRACT

An image forming apparatus includes a sheet accommodation unit, a feed roller to feed a sheet along a conveyance path, a first encoder to detect rotation of the feed roller, a conveying roller downstream of the feed roller, a second encoder to detect rotation of the conveying roller, and a motor to drive the feed roller and the conveying roller. A first clutch switches between connecting and disconnecting the paper feed roller to the motor. A second clutch switches between connecting and disconnecting the motor to the conveying roller. A first sensor detects the sheet at a first position. A second sensor detects the sheet at a second position. A control unit controls the motor based on output from the first encoder when the sheet is at the first position and output from the second encoder when the sheet is at the second position.

20 Claims, 5 Drawing Sheets

IMAGE FORMING APPARATUS

FIELD

Embodiments described herein relate generally to an image forming apparatus and sheet conveyance mechanism for such apparatuses and the like.

BACKGROUND

In the related art, an electromagnetic clutch may be mounted on each of several types of rollers used for conveying a sheet of paper or the like through an image forming apparatus. For example, an electromagnetic clutch may be mounted on a paper feed roller or a conveying roller, and then the roller is driven by a motor attached to another roller at another position. However, since the roller is driven by the motor of another roller at some other position, the gear ratio of the roller must generally be fixed such that the rotation speed will be fixed so as to depend on the rotation speed of the motor. In order to change the rotation speed of the roller itself, it is necessary to utilize another drive train, another electromagnetic clutch, and the like. Therefore, though the conveyance control of a sheet becomes simpler, and it may be difficult to deal with conveyance failures (paper jams) or the like.

DETAILED DESCRIPTION

In general, according to one embodiment, an image forming apparatus includes a sheet accommodation unit configured to store a sheet, a paper feed roller configured to feed the sheet from the sheet accommodation unit along a conveyance path, a first encoder configured to detect a rotation amount of the paper feed roller, a conveying roller downstream of the paper feed roller along the conveyance path and configured to convey the sheet along conveyance path, a second encoder configured to detect a rotation amount of the conveying roller, and a motor configured to drive the paper feed roller and the conveying roller. A first clutch is provided to switch between connecting and disconnecting the paper feed roller to the motor. A second clutch is provided to switch between connecting and disconnecting the motor to the conveying roller. A first sensor is positioned to detect the sheet at a first position along the conveyance path. A second sensor is positioned to detect the sheet at a second position along the conveyance path. A control unit is configured to control the driving of the motor based on a detection result from the first encoder when the sheet is detected at the first position and a detection result from the second encoder when the sheet is detected at the second position.

Hereinafter, an image forming apparatus according to at least one example embodiment will be described with reference to the drawings.

Figure 1:
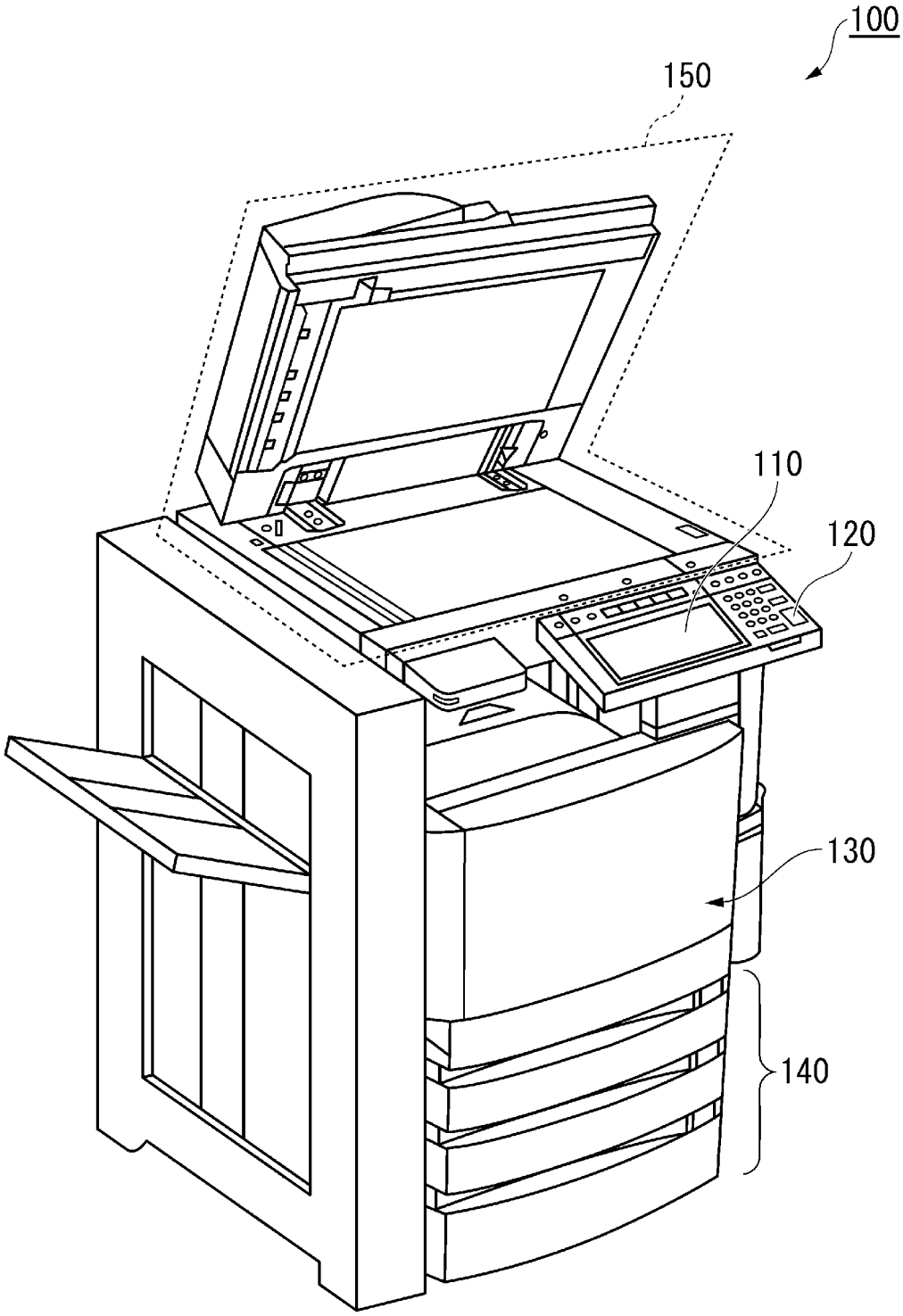
FIG. 1 depicts an overall configuration example of an image forming apparatus according to an embodiment.

FIG. 1 depicts an image forming apparatus 100 according to an embodiment. The image forming apparatus 100 is a multi-function peripheral (MFP) that can form a toner image on a sheet. The sheet is, for example, paper on which text characters, an image, or the like can be formed. In general, the sheet may be of any material type as long as the image forming apparatus 100 can form an image on the sheet. The image forming apparatus 100 can also read an image that has been formed on a sheet to generate digital data by a scanning operation or the like and generates image information (e.g., a print job) using the digital data for printing information on other sheets.

The image forming apparatus 100 executes printing through combination of an image forming process followed by an image fixing process. The image forming process is a process of forming an image on a sheet according to image information or the like using toner or another recording agent. The image fixing process is a process of fixing the image that has been formed on the sheet to the sheet.

The image forming apparatus 100 includes a display 110, a control panel 120, a printer unit 130, a sheet accommodation unit 140, and an image reading unit 150.

The display 110 is an image display device such as a liquid crystal display or an organic electro luminescence (EL) display. The display 110 displays various information relating to operations and functions of the image forming apparatus 100. In an example, the display 110 can also output a signal corresponding to a selection operation input (input operation) or the like from the user to a control unit of the image forming apparatus 100. That is, the display 110 can be touch panel display that receives the input operations of the user.

The control panel 120 includes an input operation unit. The input operation unit includes a plurality of buttons, keys, switches and/or the like. The input operation unit receives an input operation from a user. For example, the input operation unit receives an input instruction for selecting the type of the sheet to be used in a print job and a print start instruction. The input operation unit outputs a signal corresponding to the operation that has been executed by the user to the control unit of the image forming apparatus 100. The display 110 and the control panel 120 may be configured as an integrated into a touch panel in some examples.

The printer unit 130 executes an image forming process and an image fixing process. Specifically, the printer unit 130 forms an image on the sheet based on image information generated by the image reading unit 150 or image information received through a network or other communication path. The printer unit 130 forms a toner image on a sheet after the leading end of the sheet has been aligned by a registration roller 40. After the toner image is formed, the printer unit 130 applies heat and pressure to fix the toner image to the sheet. The printer unit 130 can be referred to as an image forming unit in some contexts.

The sheet accommodation unit 140 includes at least one paper feed cassette. In some examples, a plurality of paper feed cassettes may be provided in the sheet accommodation unit 140. The different paper feed cassettes may accommodate different predetermined types of sheets having, for example, predetermined standard sizes or the like. In the present example, different types of sheets have different thicknesses. Examples of the predetermined different types of sheets include plain paper and thick paper.

The image reading unit 150 reads image information from a reading target (e.g., a document) based on the brightness (and darkness) of reflected light. For example, the image reading unit 150 reads image information that is printed on a sheet then placed on a document scanning platen, an automatic document feeder device, or the like. The image reading unit 150 records the image information read from the printed sheet. The recorded image information may also be transmitted to another information processing apparatus via a network. The printer unit 130 may form an image on another sheet based on the recorded image information. The image reading unit 150 incorporates for example, an auto document feeder (ADF).

Figure 2:
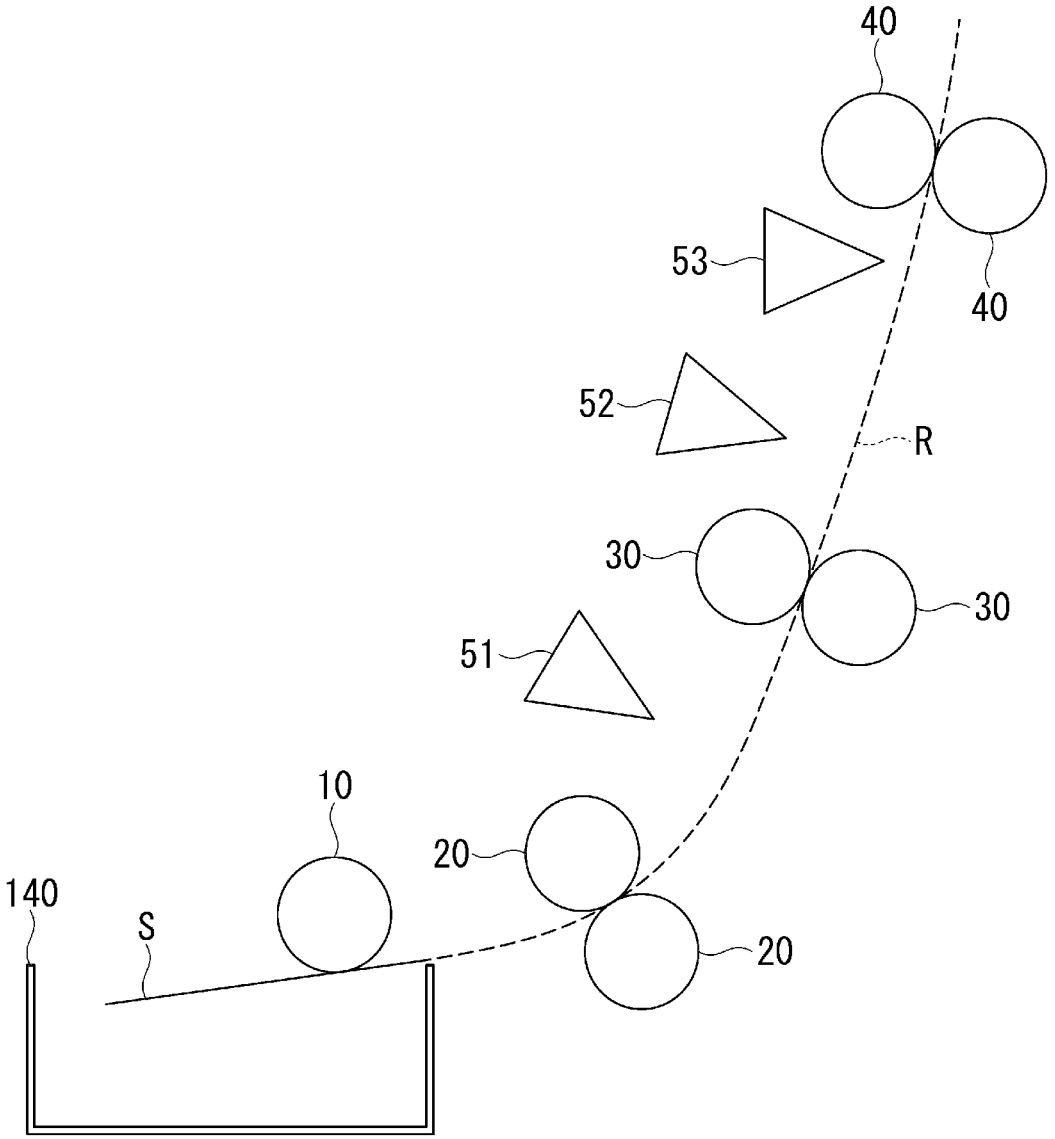
FIG. 2 is a diagram illustrating a configuration for conveying a sheet from a sheet accommodation unit to a position immediately before a printer unit in an image forming apparatus according to an embodiment.

FIG. 2 is a diagram illustrating a configuration used for conveying a sheet from the sheet accommodation unit 140 to a position immediately before the printer unit 130 in the image forming apparatus 100 according to the present embodiment.

FIG. 2 illustrates a pickup roller 10, a pair of paper feed rollers 20, a pair of conveying rollers 30, a pair of registration rollers 40, a post-separation sensor 51, a conveyance sensor 52, and a pre-registration sensor 53. The dotted line R in FIG. 2 indicates the conveyance path along which a sheet S is conveyed.

The pickup roller 10 picks up the sheets S stored in the sheet accommodation unit 140 one by one.

The paper feed rollers 20 feed the sheet S downstream along the conveyance path R. The paper feed rollers 20 convey the sheet S to the registration rollers 40. In this context, downstream or on the downstream side refers to the direction in which the sheet S is conveyed along the conveyance path. The downstream side is in the direction more toward the registration roller 40 from the paper feed rollers 20 or the pickup roller 10. The paper feed rollers 20 are provided at positions facing each other. Each paper feed roller 20 can be controlled by a control unit 60 to rotate.

The conveying rollers 30 convey the sheet S from the paper feed roller 20 further to the downstream side. The conveying rollers 30 convey the sheet S to the registration rollers 40. The conveying rollers 30 are provided at positions facing each other. Each conveying roller 30 can be controlled by the control unit 60 to rotate.

The registration rollers 40 convey the sheet S from the conveying rollers 30 further to the downstream side. In the present example, the registration rollers 40 conveys the sheet S to the downstream side after first functioning to align the leading end of the sheet S being conveyed by the conveying rollers 30. For example, the registration rollers 40 function to align the leading end of the sheet by permitting the sheet S being conveyed onward by the conveying rollers 30 to abut against non-rotating registration rollers 40. The registration rollers 40 are provided at positions facing each other. Each registration roller 40 can be controlled by the control unit 60 to rotate. The printer unit 130 forms a toner image on the sheet S conveyed to the downstream side of the registration rollers 40.

The post-separation sensor 51 is provided along the conveyance path R between the paper feed rollers 20 and the conveying rollers 30. The post-separation sensor 51 detects presence of the sheet S being fed by the paper feed rollers 20.

The conveyance sensor 52 is provided along the conveyance path R between the conveying rollers 30 and the registration rollers 40. The conveyance sensor 52 detects the presence of the sheet S being conveyed by the conveying roller 30.

The pre-registration sensor 53 is provided downstream of the conveyance sensor 52 along the conveyance path R between the conveying rollers 30 and the registration rollers 40. The pre-registration sensor 53 also detects presence the sheet S being conveyed by the conveying roller 30.

The distance between the pair of paper feed rollers 20 and the pair of conveying rollers 30 and the distance between the pair of conveying rollers 30 and the pair of registration rollers 40 are both less than a length of the sheet S.

Figure 3:
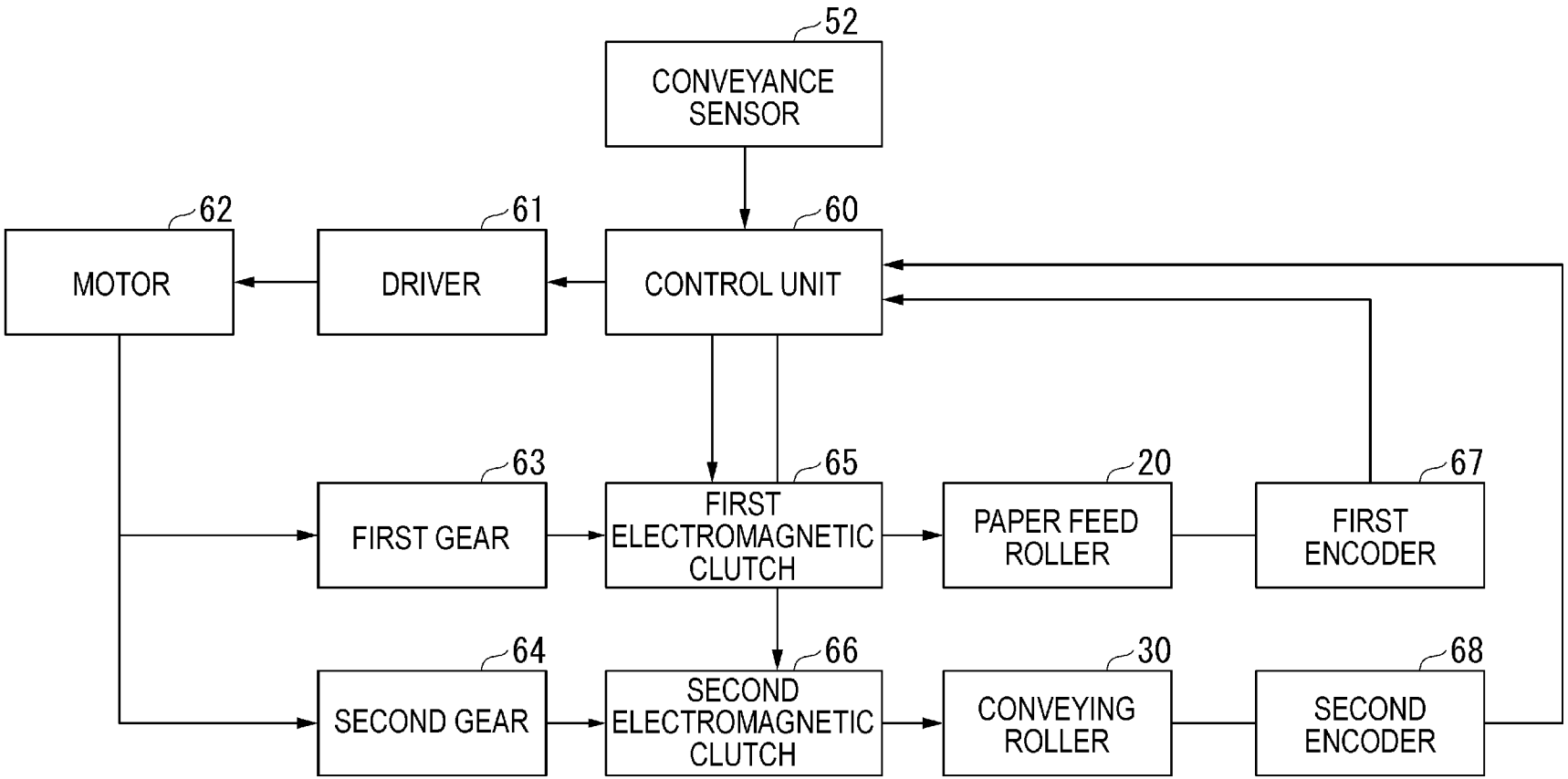
FIG. 3 is a diagram illustrating a configuration related to control of driving rollers in an image forming apparatus according to an embodiment.

FIG. 3 is a diagram illustrating a configuration for driving the various rollers in the image forming apparatus 100 according to an embodiment. FIG. 3 illustrates the configuration for controlling the driving of the pair of paper feed rollers 20 and the pair of conveying rollers 30. In addition to the paper feed roller 20, the conveying roller 30, and the conveyance sensor 52, the image forming apparatus 100 includes a control unit 60, a driver 61, a motor 62, a first gear 63, a second gear 64, a first electromagnetic clutch 65, a second electromagnetic clutch 66, a first encoder 67, and a second encoder 68.

The control unit 60 is a processor such as a central processing unit (CPU) or a graphics processing unit (GPU). The control unit 60 controls operations of the respective functional units of the image forming apparatus 100. The control unit 60 executes various processes by loading a program stored in a read only memory (ROM) to a random access memory (RAM) and executing the loaded program. In some examples, an application specific integrated circuit (ASIC) may be utilized to provide some or all of the functions provided by the control unit 60. In this context, an ASIC is one type of a dedicated hardware circuit that may be utilized or provided for implementing a specific function of the control unit 60.

The control unit 60 controls the driving of the motor 62 via the driver 61. Here, controlling the driving of the motor 62 refers to controlling the rotation speed or the positioning of the motor 62 by controlling a value of a control parameter of the motor 62. The control unit 60 controls the driving of the motor 62, for example, by executing feedback control using proportional-integral-differential (PID) process control. In this context, a control parameter a setting or value for one of the elements P, I, and D used for the PID process control.

The driver 61 controls the driving of the motor 62 based on a control signal output from the control unit 60.

The motor 62 drives at least one paper feed roller 20 and one conveying roller 30. Specifically, in this example, the motor 62 rotates based on the control parameter set by the driver 61 for supplying power for driving the paper feed roller 20 and the conveying roller 30. The motor 62 is, for example, a direct current (DC) motor with a brush type design (a brushed DC motor).

The first gear 63 is a physical component for transmitting the rotation of the motor 62 to the first electromagnetic clutch 65. The second gear 64 is a physical component for transmitting the rotation of the motor 62 to the second electromagnetic clutch 66.

The first electromagnetic clutch 65 switches between connection and disconnection states for transmission of rotational power provided by the motor 62 to the paper feed roller 20 via the first gear 63. Specifically, the first electromagnetic clutch 65 is connected or disconnected to/from the paper feed roller 20 in accordance with the control of the control unit 60. When connected, the first electromagnetic clutch 65 transmits power from the motor 62 to the paper feed roller 20. The first electromagnetic clutch 65 can also disconnect the paper feed roller 20 from the motor 62 in accordance with the control of the control unit 60.

The second electromagnetic clutch 66 similarly switches between connection and disconnection states for transmission of power from the motor 62 to conveying roller 30. Specifically, the second electromagnetic clutch 66 is connected or in accordance with the control of the control unit 60.

The first encoder 67 is provided on a shaft of the paper feed roller 20 and detects a rotational amount of the paper feed roller 20. The first encoder 67 outputs a detection result corresponding the amount of rotation of the paper feed roller 20 to the control unit 60. In this example, the first encoder 67 outputs a pulse signal corresponding to the rotation amount of the paper feed roller 20.

The second encoder 68 is provided on a shaft of the conveying roller 30 and detects a rotational amount of the conveying roller 30. The second encoder 68 outputs a detection result correspond to the amount of rotation of the conveyance roller 30 to the control unit 60. In this example, the second encoder 68 outputs a pulse signal corresponding to the rotation amount of the conveying roller 30.

The control unit 60 controls the motor 62 using the detection result from the first encoder 67 or the second encoder 68 depending on the current position of the sheet S. For example, at least until the sheet S is detected by the conveyance sensor 52 after the start of conveyance of the sheet S, the control unit 60 controls the motor 62 based on the detection result of the first encoder 67.

More specifically, the control unit 60 executes PID control for the rotation of the motor 62 based on the pulse signal representing the rotation amount of the paper feed roller 20 that is obtained from the first encoder 67. The control unit 60 calculates the speed of roller rotation (and/or sheet S conveyance speed) based on the pulse signal obtained from the first encoder 67. The control unit 60 calculates a command value (operation amount) based on the difference between the calculated (measured) speed and the speed setting that is currently set for the motor 62. For example, the control unit 60 controls the speed of the motor 62 by changing the pulse-width-modulation (PWM) duty based on the calculated command value. In the following description, controlling the motor 62 based on the detection result of the first encoder 67 will be referred to as "first parameter control".

Until the sheet S is detected by the conveyance sensor 52, the control unit 60 connects the first electromagnetic clutch 65 and the paper feed roller 20 to each other to transmit power from the motor 62 to the paper feed roller 20 according to a parameter set by the first parameter control.

Once the sheet S is detected by the conveyance sensor 52, the control unit 60 begins to control the motor 62 based on the detection result of the second encoder 68. More specifically, the control unit 60 executes PID control on the rotation of the motor 62 based on the rotation amount of the conveying roller 30 from the second encoder 68. In the following description, controlling the motor 62 based on the detection result of the second encoder 68 will be referred to as "second parameter control".

Before a new sheet S is conveyed after a previous sheet S has been conveyed, the control unit 60 switches the control of the motor 62 from the second parameter control back to the first parameter control. This return may occur any time after the previous sheet S passes the registration roller 40 until before the new (next) sheet S is conveyed.

When a sheet S is detected by the conveyance sensor 52, the control unit 60 disconnects the first electromagnetic clutch 65 and the paper feed roller 20 and connects the second electromagnetic clutch 66 and the conveying roller 30 to transmit power from the motor 62 to the conveying roller 30 using a parameter set according to the second parameter control. In some examples, even when the sheet S is detected by the conveyance sensor 52, the control unit 60 does not necessarily need to cut disconnect the first electromagnetic clutch 65 from the paper feed roller 20, but rather the paper feed roller 20 may still be actively driven.

Figure 4:
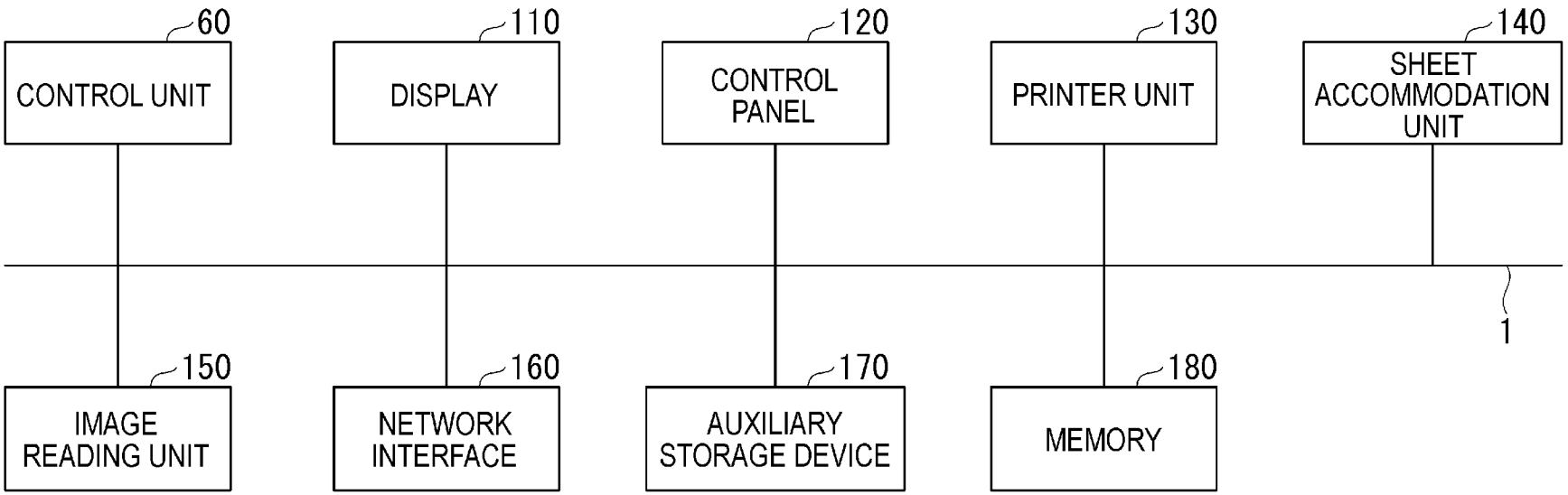
FIG. 4 is a block diagram illustrating certain aspects of an image forming apparatus according to an embodiment.

FIG. 4 is a block diagram illustrating certain aspects of the image forming apparatus 100 according to an embodiment. FIG. 4 illustrates apart of the hardware configuration of image forming apparatus 100.

The image forming apparatus 100 includes control unit 60, display 110, control panel 120, printer unit 130, sheet accommodation unit 140, image reading unit 150, network interface 160, auxiliary storage device 170, and memory 180. The respective units are connected to each other through a system bus 1 for data communication.

The control unit 60, the display 110, the control panel 120, the printer unit 130, the sheet accommodation unit 140, and the image reading unit 150 are described above. Aspects of the network interface 160, the auxiliary storage device 170, and the memory 180 will be described below.

The network interface 160 transmits and receives data to and from another apparatus. The network interface 160 operates as one example of an input interface and can receive data such as print data, image data, and user selections and the like from an external apparatus. In addition, the network interface 160 operates as an output interface and transmits data to an external apparatus.

The auxiliary storage device 170 is, for example, a hard disk or a solid-state drive (SSD) and stores various data. The various data includes, in this context, digital data, a print job, a job log, and a control parameter (e.g., a parameter setting/value). The digital data can be image information generated by the image reading unit 150 scanning of a document or the like.

The memory 180 is, for example, Random. Access Memory (RAM). The memory 180 temporarily stores data. The memory 180 may store the digital data generated by the image reading unit 150. The memory 180 may temporarily store a print job and a job log.

Figure 5:
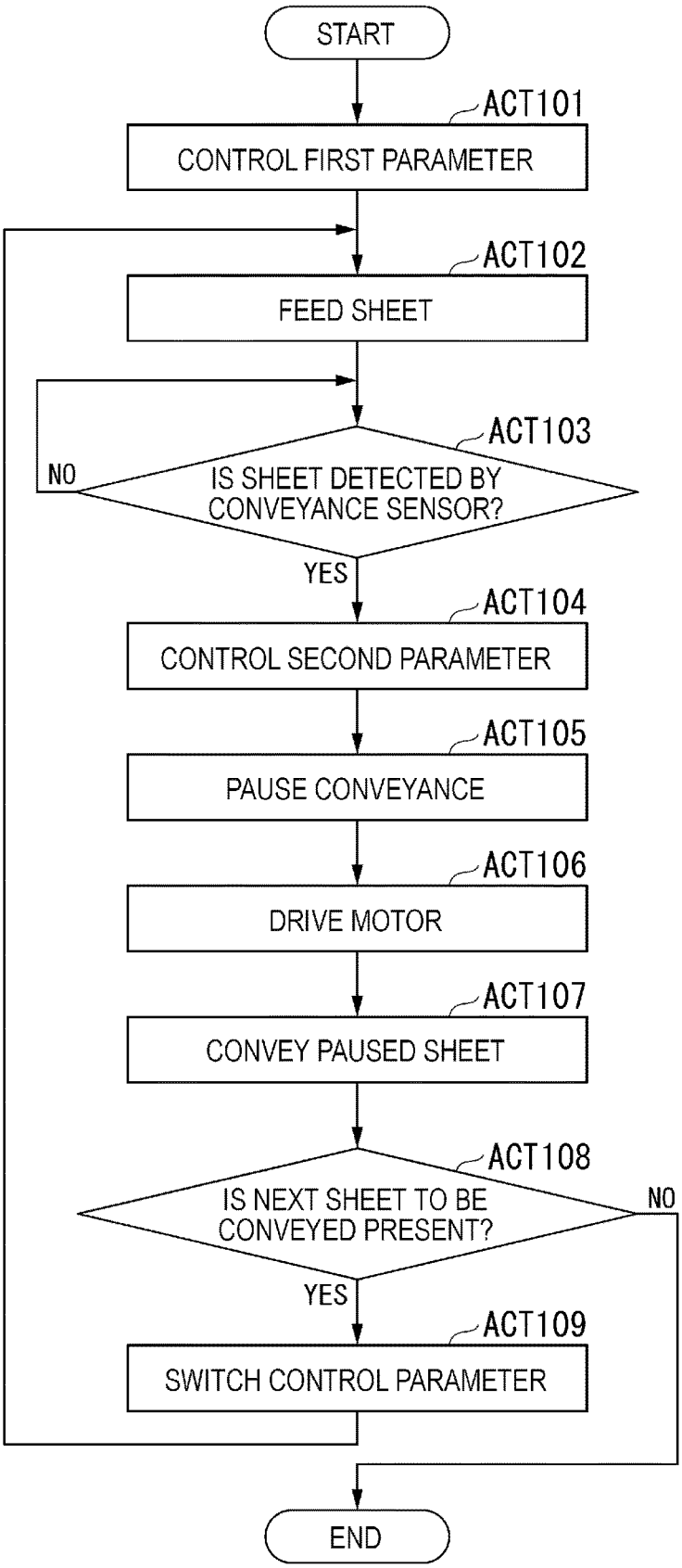
FIG. 5 is a flowchart illustrating aspects of a conveyance process that is executed by an image forming apparatus according to an embodiment.

FIG. 5 is a flowchart illustrating a conveyance process that is executed by the image forming apparatus 100 according to the present embodiment. The process of FIG. 5 is executed after an instruction to start printing is received.

Based on the instruction to start printing, the control unit 60 connects the first electromagnetic clutch 65 to the paper feed roller 20 and the second electromagnetic clutch 66 to the conveying roller 30 and then drives the motor 62. Due to this process, the power from the motor 62 is transmitted to both the paper feed roller 20 and the conveying roller 30. At this time, the control unit 60 controls the rotation of the motor 62 through the first parameter control (ACT 101). That is, the control unit 60 controls the rotation of the motor 62 through the PID control based on the detection result obtained from the first encoder 67.

In the present example, the pickup roller 10 and the paper feed roller 20 rotate with power obtained from the motor 62 according to a parameter controlled by the first parameter control. The pickup roller 10 picks up a single sheet S from the sheet accommodation unit 140. The sheet S that is picked up from the sheet accommodation unit 140 is conveyed to the conveyance path R. The paper feed roller 20 feeds the sheet S to the downstream side (ACT 102).

The sheet S that is fed by the paper feed roller 20 passes the post-separation sensor 51. The post-separation sensor 51 detects the sheet S and outputs the detection result to the control unit 60. The detection result output from the post-separation sensor 51 includes at least information representing a detection time and information representing that the sheet S has been detected. The control unit 60 can detect that the sheet S is within a detection range of the post-separation sensor 51 based on the detection result output from the post-separation sensor 51.

The conveying roller 30 then conveys the sheet S that is fed by the paper feed roller 20 to the downstream side. The sheet S conveyed by the conveying roller 30 eventually passes the conveyance sensor 52. The conveyance sensor 52 detects the sheet S and outputs the detection result to the control unit 60. The detection result output from the conveyance sensor 52 includes at least information representing a detection time and information representing that the sheet S has been detected.

The control unit 60 checks whether or not the sheet S has been detected by the conveyance sensor 52 (ACT 103).

If the sheet S has not been detected by the conveyance sensor 52 (ACT 103: NO), the control unit 60 waits until the sheet S is detected by the conveyance sensor 52. If the sheet S is detected by the conveyance sensor 52 (ACT 103: YES), the control unit 60 begins to control the rotation of the motor 62 through the second parameter control (ACT 104). That is, the control unit 60 controls the rotation of the motor 62 through the PID control based on the detection result obtained from the second encoder 68.

This way, once the sheet S is detected by the conveyance sensor 52, the control unit 60 switches the control of the motor 62 from the first parameter control to the second parameter control. The conveying roller 30 rotates with power obtained from the motor 62 as set by a parameter controlled by the second parameter control. The sheet S conveyed by the conveying roller 30 eventually passes the pre-registration sensor 53 after passing the conveyance sensor 52. The pre-registration sensor 53 detects the sheet S and outputs the detection result to the control unit 60. The detection result output from the pre-registration sensor 53 includes at least information representing a detection time and information representing that the sheet S has been detected. The control unit 60 can detect that the sheet S is within a detection range of the pre-registration sensor 53 based on the detection result output from the pre-registration sensor 53.

The control unit 60 pauses the conveyance of the sheet S by stopping the rotation of the conveying roller 30 once the pre-registration sensor 53 has detected the sheet (ACT 105). As a result, the sheet S is paused at a position that is somewhat downstream of the position of the pre-registration sensor 53 but not yet at the registration roller 40.

The control unit 60 then drives the motor 62 in order to convey the paused sheet S again (ACT 106). At this time, the control unit 60 controls the operation of the motor 62 with the same parameter as was being used before the pause. The conveying roller 30 rotates with power obtained from the motor 62. The paused sheet S is conveyed again by the rotation of the conveying roller 30 (ACT 107). As a result, the leading end of the sheet S abuts against the registration rollers 40 and is bent. As a result of this process, the sheet S will be aligned (sheet planar skew will be corrected). The control unit 60 next conveys the sheet S to the downstream side by rotating the registration roller 40.

After the sheet S passes the registration roller 40, the control unit 60 determines whether or not the next sheet S to be conveyed is already present (ACT 108). If the next sheet S to be conveyed is not yet present (ACT 108: NO), the image forming apparatus 100 ends the process. If the next sheet S to be conveyed is present (ACT 108: YES), the control unit 60 switches the control of the motor 62 from the second parameter control back to the first parameter control (ACT 109). Subsequently, the processing from ACT 102 onward is executed again.

With the image forming apparatus 100 having the above-described configuration, high-accuracy sheet conveyance can be implemented. Specifically, in the image forming apparatus 100, an encoder is attached to each of the paper feed roller 20 and the conveying roller 30, and the motor 62 is controlled using the detection result of the particular encoder attached to one of the rollers depending on the current position of the sheet S. As a result, the rotation speed of the motor 62 can be appropriately changed, and thus the rotation speed of the currently more important one of the rollers along the conveyance path can be changed/adjusted according to actual measured speed values for the sheet S. Accordingly, each roller can be rotated at an appropriate speed for the position of the sheet S. Therefore, high-accuracy sheet conveyance can be implemented.

In the image forming apparatus 100, a relatively simple brushed DC motor can be used as the motor 62 rather a more complicated motor design. As a result, device costs can be reduced.

When the motor 62 is a brushed DC motor (a DC motor of a brush type design), the rotation speed changes depending on the load applied to the paper feed roller 20 or the conveying roller 30. On the other hand, if the sheet S is detected by the conveyance sensor 52, the control unit 60 changes the control of the motor from the feedback control based on the detection result of the first encoder 67 provided in the paper feed roller 20 to the feedback control based on the detection result of the second encoder 68 provided in the conveying roller 30 in order to implement the control of sheet conveyance. The control unit 60 changes the value of the control parameter of the motor 62 used for the PID depending on the load applied to the roller or the roller speed. As a result, the drive configuration can be implemented with an inexpensive DC motor, and high-accuracy sheet conveyance can be implemented.

A modification example of the image forming apparatus 100 will be described.

In the above-described example embodiment, a brushed DC motor is used as the motor 62. However, the motor 62 is not limited to being a brushed DC motor, and the motor 62 may instead be a stepping motor or a brushless motor.

In the above description, control of the motor 62 during the sheet conveyance from the sheet accommodation unit 140 to the registration roller 40 is described; however, another motor or the motor 62 may be similarly controlled for purposes of controlling sheet conveyance by rollers at various positions along a conveyance path when such rollers are controlled by a shared motor or the like. For example, the control scheme of the motor 62 described in the above embodiment may be applied to rollers in an auto-document feeder (ADF).

Certain functions of an image forming apparatus 100 in an embodiment may be realized by a computer executing program instructions. In this case, a program for realizing these functions can be recorded in a non-transitory computer-readable recording medium in installable or executable format. Such functions may then be realized by causing a computer system to read the recorded program and execute the program instructions alone or in combination with an operating system or other software recorded in the recording medium and to execute the read program.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a sheet accommodation unit configured to store a sheet;

a paper feed roller configured to feed the sheet from the sheet accommodation unit along a conveyance path;

a first encoder configured to detect a rotation amount of the paper feed roller;

a conveying roller downstream of the paper feed roller along the conveyance path and configured to convey the sheet along conveyance path;

a second encoder configured to detect a rotation amount of the conveying roller;

a motor configured to drive the paper feed roller and the conveying roller;

a first clutch configured to switch between connecting and disconnecting the paper feed roller to the motor;

a second clutch configured to switch between connecting and disconnecting the motor to the conveying roller;

a first sensor configured to detect the sheet at a first position along the conveyance path;

a second sensor configured to detect the sheet at a second position along the conveyance path; and a control unit configured to control the driving of the motor based on a detection result from the first encoder when the sheet is detected at the first position and a detection result from the second encoder when the sheet is detected at the second position.

2. The image forming apparatus according to claim 1, further comprising:

an image forming unit downstream of the conveyance roller along the conveyance path and configured to form an image on the sheet.

3. The image forming apparatus according to claim 1, wherein the control unit controls the motor based on the detection result of the first encoder until the second sensor detects the sheet at the second position.

4. The image forming apparatus according to claim 3, wherein the control unit executes proportional-integral-differential (PID) control of the motor based on the detection result from the first encoder.

5. The image forming apparatus according to claim 3, wherein, after the sheet is detected by the second sensor at the second position, the control unit controls the motor based on the detection result of the second encoder.

6. The image forming apparatus according to claim 5, wherein the control unit executes proportional-integral-differential (PID) control of the motor based on the detection result from the second encoder.

7. The image forming apparatus according to claim 3, wherein, after the start of conveyance of the sheet until the sheet is detected by the second sensor, the control unit connects the first clutch to the paper feed roller.

8. The image forming apparatus according to claim 7, wherein once the sheet is detected by the second sensor, the control unit disconnects the first clutch from the paper feed roller and connects the second clutch to the conveying roller.

9. The image forming apparatus according to claim 1, wherein the motor is a brushed DC motor.

10. The image forming apparatus according to claim 1, further comprising:

a registration roller downstream of the conveying roller along the conveyance path.

11. The image forming apparatus according to claim 10, wherein the first position is between the paper feed roller and the conveying roller, and the second position is between the conveying roller and the registration roller.

12. The image forming apparatus according to claim 1, wherein the first position is between the paper feed roller and the conveying roller, and the second position is downstream of the conveying roller.

13. An image forming apparatus, comprising:

a paper feed roller configured to feed a sheet along a conveyance path;

a first encoder configured to detect a rotation amount of the paper feed roller;

a conveying roller downstream of the paper feed roller along the conveyance path and configured to convey the sheet along conveyance path;

a second encoder configured to detect a rotation amount of the conveying roller;

a motor configured to drive the paper feed roller and the conveying roller;

a first clutch configured to switch between connecting and disconnecting the paper feed roller to the motor;

a second clutch configured to switch between connecting and disconnecting the motor to the conveying roller;

a first sensor configured to detect the sheet at a first position along the conveyance path;

a second sensor configured to detect the sheet at a second position along the conveyance path; and a control unit configured to set a control parameter for the driving of the motor based on an output signal from the first encoder when the sheet is detected at the first position and then based on an output signal from the second encoder when the sheet is detected at the second position.

14. The image forming apparatus according to claim 13, wherein the output signal from first encoder is a pulse signal corresponding to a rotation speed of the paper feed roller.

15. The image forming apparatus according to claim 13, further comprising:

a sheet accommodation unit configured to store the sheet; and a pickup roller configured to remove the sheet from the sheet accommodation unit and supply the sheet to the paper feed roller.

16. The image forming apparatus according to claim 13, wherein the first clutch is an electromagnetic clutch.

17. The image forming apparatus according to claim 13, wherein the motor is a brushed DC motor.

18. The image forming apparatus according to claim 13, wherein the first position is between the paper feed roller and the conveying roller, and the second position is downstream of the conveying roller.

19. The image forming apparatus according to claim 13, further comprising:

a registration roller downstream of the conveying roller along the conveyance path, wherein the first position is between the paper feed roller and the conveying roller, and the second position is between the conveying roller and the registration roller.

20. The image forming apparatus according to claim 19, wherein the control unit is further configured to:

pause the conveyance of the sheet after the second sensor detects the sheet at the second position, and resume conveyance of the sheet after the pause using the control parameter based on the output signal from the second encoder.

* * * * *